United States Patent [19]

Emery

[11] Patent Number: 4,529,058

[45] Date of Patent: Jul. 16, 1985

[54] EARPHONES

[76] Inventor: Earl L. Emery, 11 Tyler St., Lawrence, Mass. 01840

[21] Appl. No.: 651,479

[22] Filed: Sep. 17, 1984

[51] Int. Cl.[3] ..... H04R 25/00

[52] U.S. Cl. ..... 181/129; 179/156 R; 179/182 R

[58] Field of Search ..... 181/129, 133–136; 179/107 H, 156 R, 156 A, 182 R

[56] References Cited

U.S. PATENT DOCUMENTS 3,999,177 12/1976 Greene ..... 179/182 R X 4,020,297 4/1977 Boodie ..... 179/182 R X

*Primary Examiner*—Benjamin R. Fuller

*Attorney, Agent, or Firm*—Edward A. Gordon

[57] ABSTRACT

A mounting device for mounting an earphone in sound receiving relationship to the ear of the user, the earphone comprising a generally cylindrical housing having a suitable terminal for connection to a source of signal and an inner generally planar surface having at least one sound transmitting operture. The mounting device comprises a pair of pliable elongated arm members which are attached to the housing and have distal ends overlapping each other in opposing directions. The arms and the housing define an opening therebetween through which said ear of the user is received. The distal ends of the arm members are held in releasable engagement relative to each other whereby the opening may be decreased to secure the arms about the ear and support the earphone against the ear and increased to release the earphone from the ear. When in position about the ear(s) of the user the pliable arms are then shaped to the users personal configuration for comfort and stability.

7 Claims, 9 Drawing Figures

EARPHONES

FIELD OF THE INVENTION

The invention relates to earphone headsets and more particularly to apparatus for mounting and holding earphones on the users ears.

BACKGROUND OF THE INVENTION

In the prior art with which this invention is concerned, much effort has been directed to providing lightweight comfortable and efficient headsets to be used, for example, with apparatus containing a receiver and microphone. Headsets have evolved from bulky uncomfortable headphones which employ an inverted substantially U-shaped headband section adapted to partially encircle a person's head by sufficiently extending across the top of the head of the person wearing the device to be clamped thereto and terminating with a receiver adjacent each of such wearer's ears to lightweight versions of the same. Where the headset is to be used with portable receiving and/or transmitting devices, such as, for example, radios and tape players, and with which this invention is primarily concerned, the prior art has also been directed to the traditional headband devices which extend about the top portion of the users head with the receivers attached thereto and held thereby adjacent to the ears. While such headsets have been made less bulky through miniaturization and use of lightweight materials, such headsets provide little stability for the earphones which can easily slip with this traditional mounting device and particularly so while the individed user/wearer is quite active such as, for example, when jogging or performing aerobics. Additionally, such traditional headbands interfere with the users hair and are generally obtrusive when worn.

Accordingly, a desirable object of the present invention is to provide a simple inexpensive device which does not employ the traditional headband for mounting earphones to the users ears.

Another desirable object of the present invention is to provide a device for mounting earphones to the ears which is light in weight and unobtrusive when worn.

Another desirable object of the present invention is to provide a device which provides a stable yet comfortable mounting of the earphones to one or both ears of the user and which retains the ear phones in a desired stable pre-set position regardless of how active the user might be.

It is also a further desirable object of the present invention to provide a mounting device for earphones which is readily adjustable and pliable to the users ears in as much as human ears occur in a variety of sizes and shapes.

A still further desirable object of the present invention is to provide an earphone mounting device for individual ears and which provides for securable, detachable mounting of earphones to the ears.

SUMMARY OF THE INVENTION

The present invention generally comprises a mounting device for conventional earphones which comprise a housing, containing a standard receiver transducer, for example, a suitable terminal for connection to a source of signal and an inner planar surface having at least one sound transmitting aperture hereinafter referred to generally as earphone(s). The mounting device comprises a pair of pliable deformable arm members having ends attached in opposing directions to the earphone housing, for example, the top and bottom of the housing. From the point of attachment, the arm members extend outwardly in opposing direction to describe a generally semicircular curvature. The lengths of the arm members is such that the distal ends of the opposing arm members overlap a portion of the length of each other and together with the earphone housing form a looped opening having an overall generally oval or elliptical configuration through which the ear of the user is received. The distal overlapping ends of the arm members are held in releasable engagement and are preferably held in slidable frictional engagement with each other to permit the size of the loop opening to be increased or decreased quickly and easily to secure the arms placed about the ear as a means for holding the earphone to the users ear.

In use, the loop opening formed by the mating arm members which are attached to the speaker is increased to receive the users ear and the loop size opening adjusted by decreasing the opening to the users personal satisfaction to hold the earphone adjacent the ear opening. The pliable arms are then shaped to the users personal configuration for comfort and further stability.

BRIEF DESCRIPTION OF THE DRAWINGS

For a fuller understanding of the nature and desired objects of the invention, reference should be had to the following detailed description taken in connection with the accompanying drawings, wherein like reference characters refer to corresponding parts throughout the several views and wherein.

DETAILED DESCRIPTION OF PREFERRED EMBODIMENTS

Figure 1:
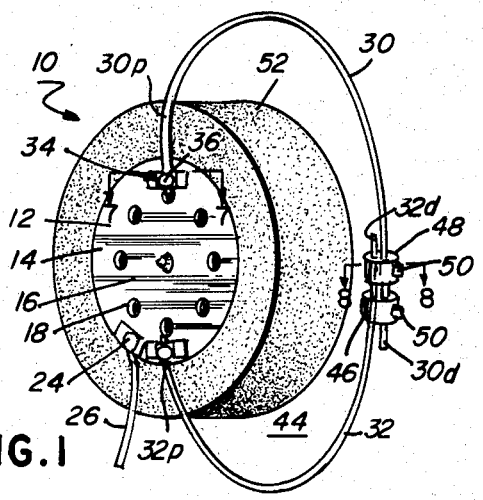
FIG. 1 is a perspective view of an earphone and mounting apparatus in accordance with the present invention.
Figure 3:
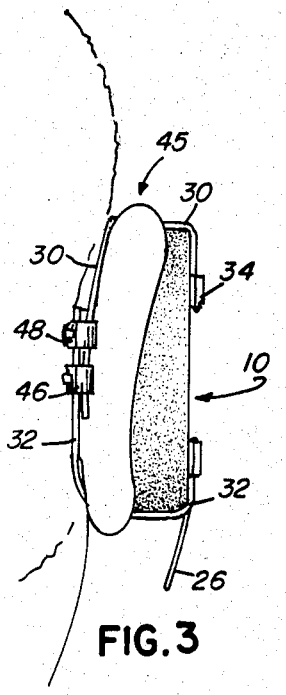
FIG. 3 is a view of the earphone of FIG. 1 as mounted on the ear of a user.
Figure 4:
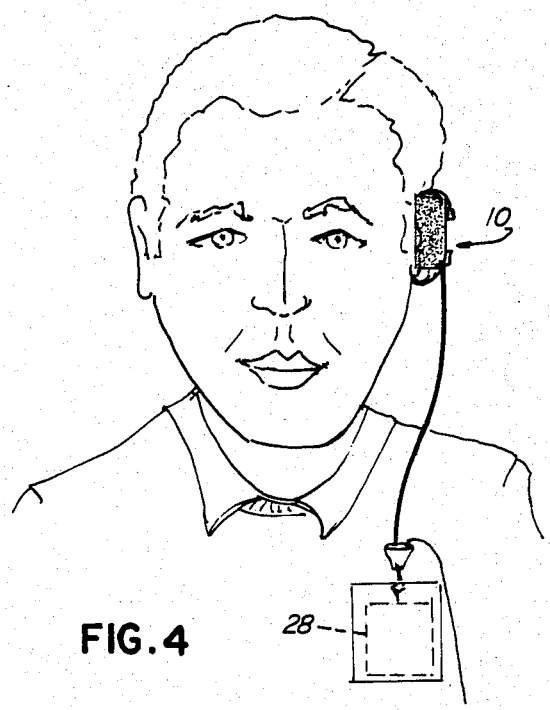
FIG. 4 is a view of the earphone of FIG. 1 as mounted on the ear of the user.
Figure 5:
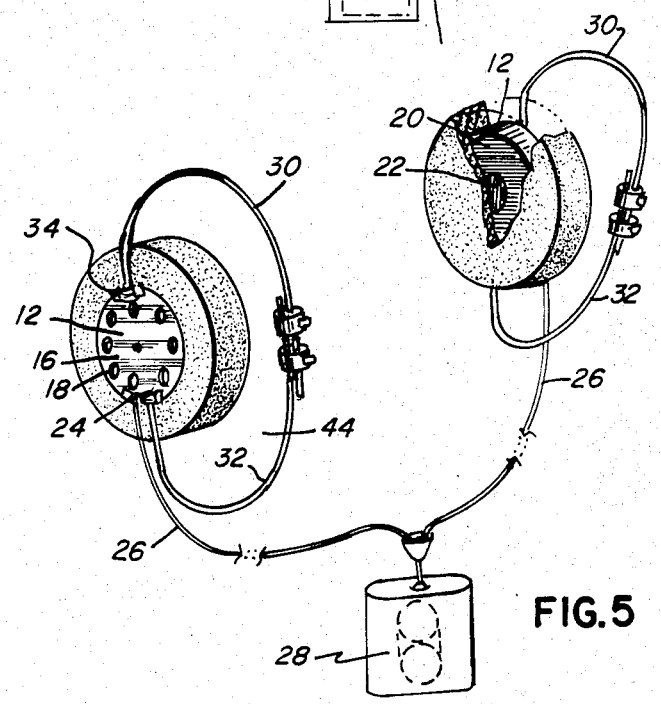
FIG. 5 is a view partially broken away of an earphone headset in accordance with the present invention as used with a portable tape player.

Referring now to the drawings and in particular to FIGS. 1 through 5 there is shown an earphone shown generally at 10 of FIG. 1 which includes a generally cylindrical housing 12. Disposed within the housing 12 is a suitable receiver transducer represented by the dotted line 14, and which may comprise any of the standard electromagnetic or piezoelectric transducers known in the art. The outer generally perpendicular planar wall 16 of housing 12 is provided with a plurality of holes or apertures 18 which vent the housing and prevent air pressure loading of the transducer during pressure changes. The corresponding inner wall 20 of housing 12 (as best seen in FIG. 5) is provided with an opening 22 for the purpose of projecting sound from the transducer to the ear. It is to be understood that instead of the single hole 22 a plurality of holes such as holes 18 may be provided for projection and transmission of the sound. The housing 12 is provided with a suitable terminal jack 24 which is connected to a suitable cable 26 that may be in turn connected to a suitable communication equipment which includes a suitable source of signal such as a tape player 28 (as best seen in FIG. 5) and well known in the art.

Figure 7:
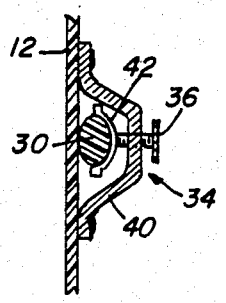
FIG. 7 is a fragmentary cross-sectional view taken along the lines 7—7 of FIG. 1.

Extending radially outwardly from the housing 12 are a pair of elongated flexible arms 30 and 32, each having proximate ends 30*p* and 32*p* and distal ends 30*d* and 32*d*. The proximate end 30*p* of arm 30 is preferably attached to the upper portion of the housing 12 and the proximate end 32*p* of arm 32 is preferably attached to the housing in a generally opposing direction. As illustrated in the drawing (as best seen in FIG. 1) the arms are attached in diametrically opposing positions on the housing 12 but may be attached at positions on the housing which are somewhat greater or lesser than diametrically opposed. The arms 30 and 32 are preferably flexible and pliably deformable so that they can be shaped to any desired configuration. One suitable material for forming the arms is a relatively thin plastic-coated wire, although other suitable materials may be used. The main requirements of the material for forming the arms are that the material be lightweight, pliably deformable and/or flexible and not be offensive to the skin of the user. The arms are attached to the housing 12 by suitable attaching means. One suitable attaching means comprises a screw actuated clamp means attached to the housing. As illustrated in FIG. 7, the attaching means 34 comprises a screw 36 carried by support wall 40 attached to housing 12 and a clamp 42 actuated by screw 36.

The lengths of the two arm members 30 and 32 made sufficiently long whereby the distal ends 30*d* and 32*d* overlap a portion of each other in opposing directions and together with the housing 12 define a loophole or opening 44 through which the ear 45 (FIG. 3) of the user is received. The overlapped distal ends 30*d* and 32*d* are releasably secured to each other preferably by securing means which provide for slidable friction movement of the arms 30 and 32 relative to each other, whereby the opening 44 may be decreased to secure the arms about the ear of the user to thereby hold the earphone adjacent the ear and increased to enlarge the opening 44 to permit removal of the arms and earphone from the users ear.

Figure 8:
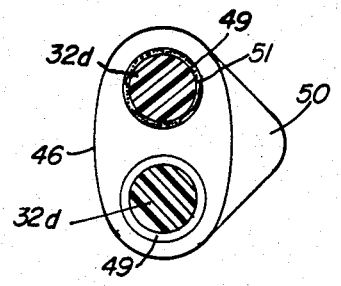
FIG. 8 is a cross-sectional view taken along the lines 8—8 of FIG. 1.

Referring now to FIGS. 1 and 8, suitable securing means are illustrated as sleeves 46 and 48. Sleeve 46 is provided with two channels 47 and 49. The distal end 30*d* of arm 30 is securely attached within channel 47 of sleeve 46 by a suitable adhesive 51. The distal end 32*d* of arm 32 is held in slidable adhesive 51. The distal end 32*d* of arm 32 is held in slidable engagement within channel 49 of sleeve 46. Similarly, sleeve 48 has the distal end 32*d* of 32 securely attached within one channel of the sleeve while permitting the distal end 30*d* of arm 30 to be held in slidable engagement within the other channel of sleeve 48. In a preferred embodiment small protrusions or flanges 50 are provided on sleeves 46 and 48 to facilitate and assist the fingers of the user in adjusting the sleeves relative to each other.

As illustrated the earphone 10 is provided with a muff 52 disposed about the periphery and inner wall of the housing. It is to be understood that the earphone may be used without the muff 52. The muff can be formed of thin lightweight, porous, foamed rubber or plastic material which may serve as a cushion between the ear and the housing and also as a wind breaker.

With respect to mounting of the earphone, the arms are formed with a curvature which would include a semi-circular curvature, extending outwardly from the points of attachment to the housing, with the arms 30 and 32 then being formed with a more gentle curvature. As mentioned, the length of these two arms 30 and 32 are constructed so that the distal ends 30*d* and 32*d* of the two curved arms, mounted in opposing directions, would overlap to form an opening having an oval or looped configuration.

The overlapping distal ends of the curved arm sections are slidably secured to each other with the sleeves 46 and 48 to provide an arrangement which permits the size of the opening 44 to be increased or decreased, with the slidable ends of the curved arm sections 30 and 32 being retained by friction within the respective channels of sleeves 46 and 48.

Accordingly in use, (reference being made to FIG. 3) the oval or loop formed by the two arm sections would be placed about the ear so that the ear is received in opening 44 as a means of holding the earphone in position. The arms would then be in position behind the ear, with arm 30 extending over the top of the ear and around the back of the ear, while arm 32 extends under the ear lobe at the bottom and around the back of the ear. The adjustable nature of the arm sections then permits the individual user to increase or decrease the size of the loop, as would be best suited for their own personal use to mount the earphone. The pliable nature of the arms also permits the user to shape the arms to a suitable configuration consistent with the comfort of the user.

It is to be understood that the arm sections and the sleeves associated with them, can be provided with a cover of suitable cushioned material to assure comfort for the user's ear. Such suitable materials to provide a cushioned outer covering, can be foamed rubber or plastic materials.

Figure 2:
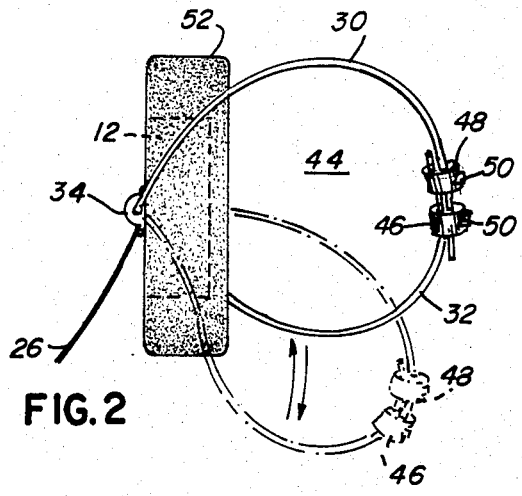
FIG. 2 is a top view of the earphone of FIG. 1 illustrating the flexibility of the mounting device.

Referring now to FIG. 2, it will be appreciated that the flexibility of the arms 30 and 32 between, for example, the position shown by the solid lines and the position shown by the dotted lines permit the accomodation of mounting the earphone to the ear whether the earphone is to be worn on the right or left ear.

Additionally, the user, can, if desired, easily attach one earphone of a headset as illustrated in FIG. 4 and leave the other ear free for safety or other reasons without the inherent problems associated with the conventional headband clamp structure.

As illustrated, the unused earphone can be in the users pocket, for example, ready for use.

Figure 6:
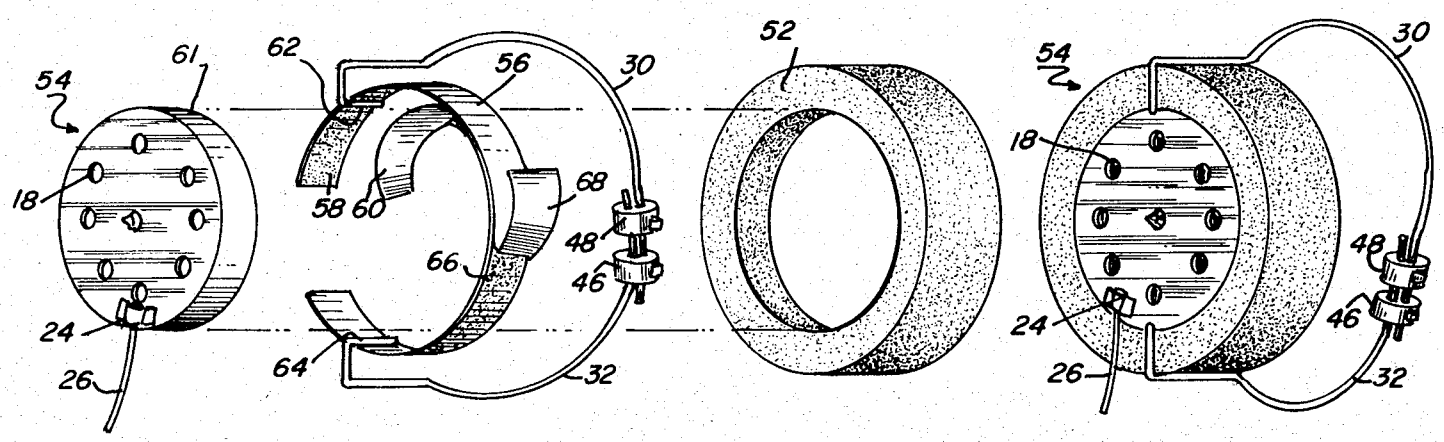
FIG. 6 is an exploded and completed view illustrated an alternate embodiment of attaching the mounting device of the present invention to a standard earphone.

Referring now to FIG. 6, there is shown an alternate embodiment for attaching the mounting arms to a standard earphone where such attaching means was not part of the original construction of the housing. As illustrated, the muff 52 is removed from the housing 54. A flat split-ring member 56 is provided preferably having at least the lower surface coated with suitable adhesive material 58 and protected by removable surface 60 well known in the art. The deformable arms 30 and 32 are bent at the proximate ends to provide sections 62 and 64 equal in length and preferably conforming to the peripheral surface 61 of the housing 54. The protective surface 60 is removed from the split-ring member 56 and arm sections 62 and 64 attached in substantially opposing positions upon the lower adhesive surface 58 of split-ring member 56. The lower adhesive surface 58 is then attached to the peripheral surface 61 of the housing 54. The muff member 52 is then positioned about the housing peripheral surface 61 and split-ring member 56. The arm members 62 and 64 are then bent or deformed over the muff 52 and serves to hold the muff in position. It should be understood that the upper surface of the split-ring member can be provided with an adhesive surface 66 and removable protective surface tape 68 in the same manner as the lower surface 58. In this case after the split-ring 56 is in position on the housing surface 61, the protective layer 68 is removed and the muff member 52 is placed about the housing surface 61 and split-ring member 56 and held in place by the upper adhesive surface 66. The split-ring member 56 may be formed of any suitable material such as a thin flat flexible plastic material.

Referring now to FIG. 3, the invention is shown from a back view in position on the right ear of the user. As illustrated, the flexible and pliably deformable arms 30 and 32 are shaped to conform to the head and ear of the user thus providing increased stability and comfort during use.

It can be appreciated that present invention provides a mounting device for earphones which eliminates the problems and limitations associated with the traditional headband for mounting earphones upon the user. The present invention provides a mounting device which enables the user to mount the earphones directly to the user's ear thus eliminating the use of a headband or similar head clamp. The present invention additionally provides for increased stability and comfort while maintaining the earphones in a desired (pre-set) position during the use particularly where the user is quite active.

It is to be understood that while the invention has been described with respect to preferred embodiments thereof, modifications may be made within the scope of the invention. For example, a portion of the distal ends 30*d* and 32*d* may be provided with co-acting materials commonly known as VELCRO to provide releasable engagement of the distal ends and thereby provide for increase and decrease of the opening 44.

Figure 9:
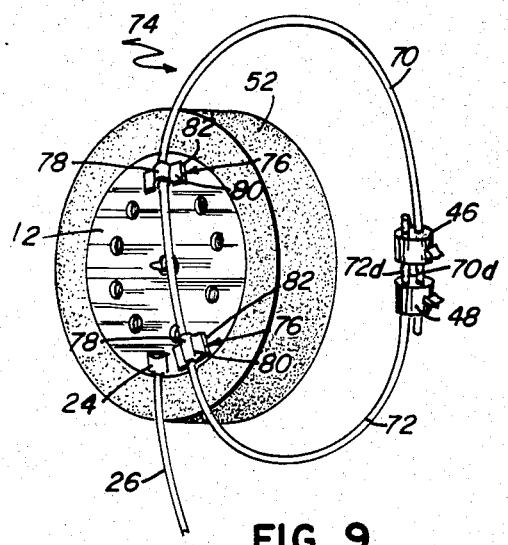
FIG. 9 is an alternate embodiment of the earphone mounting device in accordance with the present invention.

Referring now to FIG. 9 there is shown an alternate embodiment of the mounting device in accordance with the present invention. As illustrated, the arms 70 and 72 are formed from one integral elongated pliable mounting member 74. The distal ends 70*d* and 72*d* of each arm are provided with suitable means for releasable engagement of the distal ends relative to each other such as, for example, sleeves 46 and 48 as described with respect to FIG. 1. Elongated member 74 is also provided with suitable means for attaching the mounting member 74 to the housing 12. Suitable attaching means are shown as attaching members 76 which are provided with a channel means 78 through which mounting member 74 passes and upon which the attaching members are slidable. The attaching members 76 are provided with a generally flat base 80 which carries a suitable adhesive material 82 well known in the art for attaching the bases at suitable locations on the housing 12 and a removable protective tape (not shown) as described with respect to member 60 and 68 of FIG. 6.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrated and not in limiting sense.

What is claimed is:

1. A mounting device for mounting an earphone in sound receiving relationship to the ear of the user, said earphone comprising a generally cylindrical housing having means for connecting to a source of signal and an inner generally planar surface having at least one sound transmitting operture, said mounting device comprising a pair of elongated arm members attached to said housing and having distal ends overlapping each other in opposing directions, said arms and housing defining an opening therebetween through which said ear of the user is received, and means for holding said distal ends of said arms in releasable engagement relative to each other whereby said opening may be decreased to secure said arms about said ear and increased to release said ear.

2. A mounting device for mounting an earphone in sound receiving relationship to the ear of the user, said earphone comprising a generally cylindrical housing having means for connecting to a source of signal and an inner generally planar surface having at least one sound transmitting operture, said mounting device comprising a pair of elongated arm members, each of said arm members having proximate ends attached to said housing in opposing directions and distal ends overlapping each other; said arm members and housing defining an opening therebetween through which said ear of the user is received, and means for holding said distal ends of said arms in releasable engagement relative to each other whereby said opening may be decreased to secure said arms about said ear and increased to release said ear.

3. A mounting device for mounting an earphone in sound receiving relationship to the ear of the user, said earphone comprising a generally cylindrical housing having means for connecting to a source of signal and an inner generally planar surface having at least one sound transmitting operture, said mounting device comprising a pair of elongated pliable arm members, each said arm members having a proximate end and a distal end, means for attaching said proximate ends to said housing in opposing directions, said distal ends being sufficiently long so as to overlap each other, said arms and said housing defining an opening therebetween through which said ear of the user is received, and means for holding said distal ends of said arms in slidable engagement relative to each other whereby said opening may be decreased to secure said arms about said ear and increased to release said ear.

4. The mounting device of claim 3 wherein said means for holding said distal ends of said arm members in slidable engagement relative to each other comprises a pair of sleeve members each said sleeve member being attached to the distal end of said arm members and slidably engaged with the opposing arm member.

5. The mounting device of claim 3 wherein the means for attaching said proximate ends to said housing comprises a flexible member adopted to lie in engagement about a portion of said housing and having a lower surface and an upper surface, and adhesive means disposed upon the lower surface of said flexible member to secure said flexible member and said proximate ends to said housing.

6. The mounting device of claim 5 wherein a muff member is disposed about the outer surface of said flexible member and the said inner generally planar surface of said housing.

7. A mounting device for mounting an earphone in sound receiving relationship to the ear of the user, said earphone comprising a generally cylindrical housing having means for connecting to a source of signal and an inner generally planar surface having at least one sound transmitting operture, said mounting device comprising an elongated member, said elongated member having distal end portions overlapping each other in opposing directions; means mounted on said elongated member to attach said member to said housing, said distal end portions defining an opening adjacent said housing through which said ear of the user is received, and means for holding said distal end portions in releasably engagement relative to each other whereby said opening may be decreased to secure said earphone in sound receiving relationship to said ear and increased to release said earphone from said ear.

* * * * *